US005195201A

United States Patent [19]

Schlicht

[11] Patent Number: 5,195,201

[45] Date of Patent: Mar. 23, 1993

[54] METHOD OF AND APPARATUS FOR PERMEATING TEXTILE MATERIALS WITH LIQUIDS

[75] Inventor: Waldemar Schlicht, Gütersloh, Fed. Rep. of Germany

[73] Assignee: Karl Menzel Maschinenfabrik GmbH & Co. KG., Bielefeld, Fed. Rep. of Germany

[21] Appl. No.: 710,287

[22] Filed: Jun. 4, 1991

[30] Foreign Application Priority Data

Jul. 24, 1990 [DE] Fed. Rep. of Germany ..... 4023487

[51] Int. Cl.[5] ..... D06B 3/18

[52] U.S. Cl. ..... 8/151; 68/9; 68/22 R; 68/22 B

[58] Field of Search ..... 8/151; 68/9, 22 B, 22 R; 118/405

[56] References Cited

U.S. PATENT DOCUMENTS

| | | | |
|---|---|---|---|
| 347,959 | 8/1886 | Rau | 68/22 R |
| 2,240,809 | 5/1941 | Simonds | 68/22 R X |
| 3,207,616 | 9/1965 | Cohn et al. | 68/22 B X |
| 3,508,286 | 4/1970 | Rosen | 68/22 R |
| 3,881,445 | 5/1975 | Nothiger | 118/405 X |
| 4,056,954 | 11/1977 | Meier-Windhorst | 68/22 R |
| 4,449,476 | 5/1984 | Voswinckel et al. | 68/22 B X |

FOREIGN PATENT DOCUMENTS

| | | | |
|---|---|---|---|
| 1071035 | 12/1959 | Fed. Rep. of Germany | 68/22 B |
| 972743 | 10/1964 | United Kingdom | 68/22 B |

*Primary Examiner*—Philip R. Coe
*Attorney, Agent, or Firm*—Peter K. Kontler

[57] ABSTRACT

A web of textile material which is to be permeated with a liquid is caused to move upwardly through the nip of two squeezing rolls which serve to expel air and/or moisture and are immediately adjacent a liquid bath. The freshly squeezed increments of the web act not unlike sponges and thus accept substantial quantities of liquid, and the surplus of liquid is expelled from the web by two rolls which are installed above the bath and define a nip of variable width. If necessary, the web can be contacted by a suitable wetting agent on its way toward the nip of the squeezing rolls.

20 Claims, 2 Drawing Sheets

METHOD OF AND APPARATUS FOR PERMEATING TEXTILE MATERIALS WITH LIQUIDS

BACKGROUND OF THE INVENTION

The invention relates to improvements in methods of and in apparatus for contacting textile materials with liquids. More particularly, the invention relates to improvements in methods of and in apparatus for permeating running webs of textile material with liquids.

It is well known to convey a web of textile material through a liquid bath (e.g., through a bath containing one or more chemicals) in order to permeate or saturate the web with liquid. The web is caused to contact the liquid while its filaments are dry or still wet following a washing or rinsing step. The arrangement is normally such that the web is conveyed through a bath which contains a large quantity of liquid, and the permeating or saturating step is followed (a) by a squeezing step in order to expel a certain percentage of liquid medium which has been entrained by the web and (b), if necessary, with a treatment in a reaction chamber or drying chamber.

A drawback of certain presently known permeating or impregnating methods and apparatus is that it is necessary to establish and maintain a bath which contains a large quantity of liquid. Furthermore, it is necessary to continuously test and titrate the bath.

It is also known to convey a web of textile material along a downwardly extending path while successive increments move toward, through and beyond a liquid bath. Excess liquid is stripped off at a level beneath the liquid bath. It has been found that penetration of liquid from the bath into the moving web is adversely affected by air which is confined and is entrained by a dry web, or by moisture which is confined in and is entrained by a wet web. The liquid of the bath is supposed to expel air or moisture from the running web in the course of the permeating or saturating step; this invariably results in unpredictable impregnation of the web.

OBJECTS OF THE INVENTION

An object of the invention is to provide a novel and improved method which renders it possible to properly permeate a rapidly running web of textile material with a liquid while the web advances through a relatively small liquid bath.

Another object of the invention is to provide a method which ensures more predictable and more uniform impregnation or saturation of the running web than heretofore known methods.

A further object of the invention is to provide a method which renders it possible to operate with a small liquid bath and which ensures that the permeating operation is not affected by air or by liquid in those increments of the running web which approach the liquid bath.

An additional object of the invention is to provide a method which can be carried out in a small area and which renders it possible to utilize the liquid medium of the bath in an economical manner.

Still another object of the invention is to provide a novel and improved apparatus which can be utilized for the practice of the above outlined method.

A further object of the invention is to provide a novel and improved vessel for confinement of the liquid bath in the apparatus for the practice of the above outlined method.

Another object of the invention is to provide a simple, compact and inexpensive web permeating or saturating apparatus.

An additional object of the invention is to provide an apparatus which ensures that a small liquid bath suffices for predictable impregnation or saturation of each increment of a rapidly moving wide or narrow web of textile material.

A further object of the invention is to provide the apparatus with novel and improved means for preventing the running web from entraining air and/or moisture into the liquid bath.

Another object of the invention is to provide an apparatus which can be rapidly adjusted for the treatment of different types of textile materials.

Still another object of the invention is to provide the apparatus with novel and improved means for relieving successive increments of the running web of entrapped air and/or moisture just before the increments enter the liquid bath to be permeated with a chemical (e.g., a coloring agent) or with another liquid medium.

SUMMARY OF THE INVENTION

One feature of the present invention resides in the provision of a method of permeating a textile material with a liquid. The method comprises the steps of moving a web of textile material in a predetermined direction along a predetermined path having a first portion wherein the web moves from a lower level to a higher level and a second portion immediately preceding the first portion, squeezing the web in the second portion of the path, and establishing and maintaining a liquid bath at the first portion of the path so that the web moves through and is saturated with and entrains liquid immediately following the squeezing step and while moving from the lower level to the higher level.

At least one of the first and second portions of the path is or can be at least substantially vertical. Thus, the web can move from a lower level to a higher level in the first as well as in the second portion of the path.

The method preferably further comprises the step of expelling a portion of entrained liquid in a third portion of the path downstream of the first portion. Such method preferably further comprises the step of returning expelled liquid into the bath.

Still further, the method can comprise the step of contacting the web with a wetting agent (e.g., a tenside) in an additional portion of the path upstream of the first portion, preferably upstream of the second portion.

Another feature of the invention resides in the provision of an apparatus for permeating a textile material with a liquid. The improved apparatus comprises means for moving a web of textile material in a predetermined direction along a predetermined path having a first portion wherein the web is moved from a lower level to a higher level and a second portion immediately upstream of the first portion, means for squeezing the web in the second portion of the path, and a liquid bath-containing vessel surrounding the first portion of the path so that the web is contacted by liquid in the vessel while moving from the lower level to the higher level immediately following squeezing in the second portion of the path and the web entrains some liquid from the bath. At least one of the first and second portions of the path is or can be at least substantially vertical.

The squeezing means preferably includes a pair of rolls which define for the moving web a substantially horizontal nip in the second portion of the path. The moving means is operative to advance successive increments of the web upwardly through the nip and into the liquid bath in the vessel.

The squeezing means can form part of the vessel. To this end, the vessel further comprises a first end wall which sealingly engages the end faces of the rolls at one end of the nip, and a second end wall which sealingly engages the end faces of the rolls at the other end of the nip. Such apparatus further comprises means for rotating the rolls in opposite directions so as to move the web upwardly into and through the liquid bath. The peripheral surfaces of the rolls entrain liquid from the bath while the rolls are being rotated in opposite directions, and such apparatus preferably further comprises means for wiping the liquid off the peripheral surfaces of the rolls outside of the liquid bath in the vessel. The wiping means can comprise rollers which contact the peripheral surfaces of the rolls at a level above the liquid bath in the vessel so as to return the wiped off liquid into the bath.

The apparatus further comprises means for replenishing the supply of liquid in the vessel in order to compensate for entrainment of some liquid by successive increments of the moving web. The replenishing means is preferably adjustable, and the apparatus then further comprises means for adjusting the replenishing means so as to maintain the supply of liquid in the bath at a substantially constant value. The adjusting means can comprise means for monitoring the level of the top surface of the liquid bath in the vessel.

The apparatus can also comprise means for expelling some of the entrained liquid from the web in an additional portion of the path downstream of the first portion. The expelling means can comprise a second pair of rolls which define for the moving web a nip in the additional portion of the path. The apparatus preferably comprises means for shifting at least one of the squeezing rolls and/or at least one of the expelling rolls relative to the other roll to thereby vary the width of the respective nip and hence the squeezing and/or expelling action. The shifting means can include at least one fluid-operated (pneumatic or hydraulic) motor.

Still further, the apparatus can comprise means for contacting the web with a wetting agent in an additional portion of the path upstream of the first portion (preferably upstream of the second portion).

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
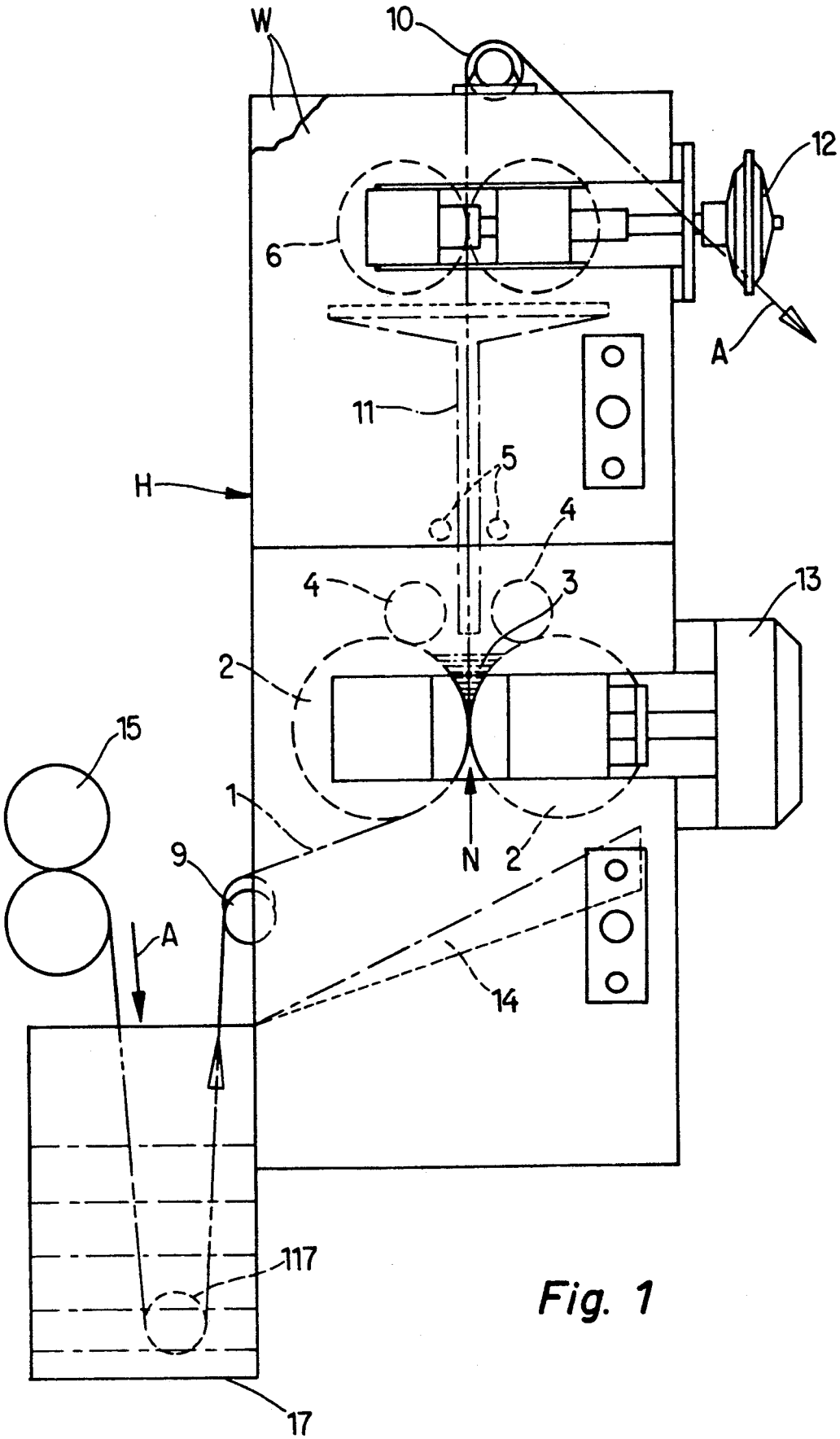
FIG. 1 is a schematic elevational view of an apparatus which embodies one form of the invention.
Figure 2:
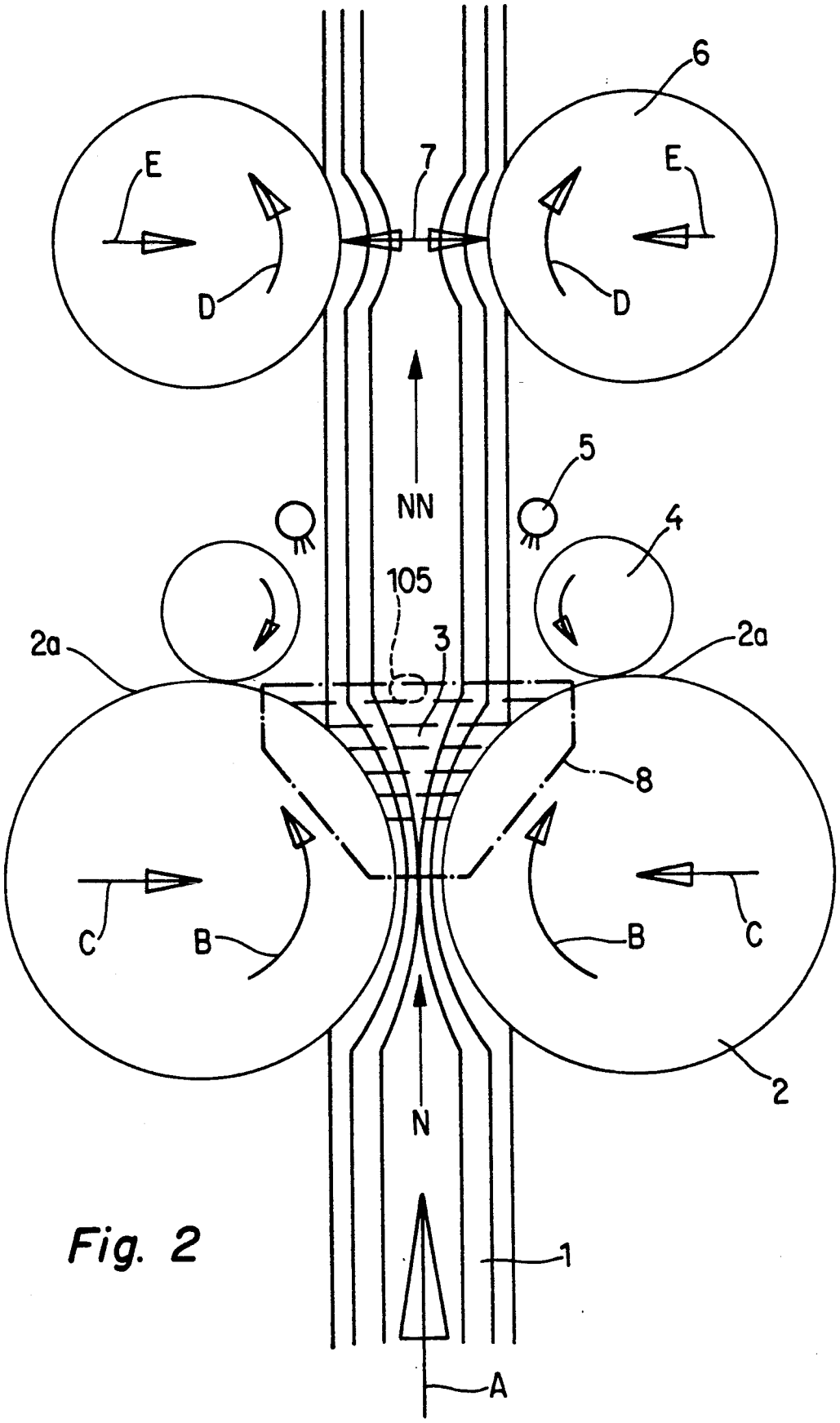
FIG. 2 is an enlarged view of a detail in the apparatus of FIG. 1, with the housing omitted.

The apparatus which is shown in FIGS. 1 and 2 comprises a housing or frame H and a mechanism for moving an elongated web 1 of textile material along an elongated path. The moving means includes a first pair of advancing rolls 15 at least one of which is driven to move the web 1 in the direction of arrow A, and another pair of advancing rolls (not specifically shown) downstream of a pulley 10 which is mounted at the top of the housing H. The apparatus further comprises a squeezing mechanism including two parallel horizontal rolls 2 which are installed between the two upright walls or checks W of the housing H. The axes of the rolls 2 are located in a horizontal plane and are parallel to each other so that the rolls define an elongated nip N in a vertical portion of the path for the web 1, such vertical portion being immediately adjacent and being located beneath a vertical path portion which is surrounded by a body 3 of liquid immediately above the nip N. The liquid body is confined in part by the rolls 2 (i.e., the squeezing mechanism forms part of a vessel for the liquid) and in part by two upright walls 8 (one indicated in FIG. 2 by phantom lines) which sealingly engage the adjacent end faces of the rolls 2. The peripheral surfaces 2*a* of the rolls 2 rotate in opposite directions (note the arrows B in FIG. 2) when the improved apparatus is in actual use; to this end, at least one of the rolls 2 is driven by a motor (not shown) or the rolls 2 rotate as a result of frictional engagement with successive increments of the moving web 1.

The width of the nip N can be varied by shifting at least one of the rolls 2 relative to the other roll in or counter to the directions indicated by arrows C. FIG. 1 shows a fluid-operated (hydraulic or pneumatic) shifting mechanism 13 for the right-hand squeezing roll 2. It is within the purview of the invention to provide a second shifting mechanism for the left-hand squeezing roll 2, and such second shifting mechanism may but need not be identical with the illustrated mechanism 13. Shiftability of at least one of the rolls 2 is desirable and advantageous in order to select the intensity of the squeezing action upon successive increments of a particular running web 1 of textile material or to rapidly convert the apparatus for the treatment of webs having different thicknesses or necessitating expulsion of larger or smaller quantities of entrapped air or moisture immediately ahead of the liquid bath 3 in the vessel including the rolls 2 and the end walls 8.

The liquid bath 3 in the vessel can contain one or more chemical substances (e.g., dyes) which are needed to ensure proper coloration of the web 1 and/or for other purposes. The nip N is located downstream of a further pulley 9 which is installed in the housing H to change the direction of movement of the web 1 in a path portion which is located upstream of the path portion flanked by the peripheral surfaces 2*a* of the squeezing rolls 2. A second vessel 17 which is, or which can be, carried by the housing H contains a suitable wetting agent (e.g., a tenside) through which the web 1 is caused to advance on its way from the nip of the advancing rolls 15 toward the pulley 9 and thence toward the nip N of the squeezing rolls 2. The wetting agent in the vessel 17 surrounds a pulley 117. The pulley 117 and/or the pulley 9 can be provided with or can cooperate with means for spreading or expanding the running web 1 ahead of the nip N and ahead of the vessel for the liquid bath 3. The manner in which the end walls 8 of the vessel for the liquid bath 3 sealingly engage the adjacent end faces of the rolls 2, while permitting the rolls 2 to rotate about their respective axes and while permitting at least one of the rolls to move toward or away from the other roll in order to change the width of the nip N, is known in the art and need not be described here. For example, the walls 8 and/or the end faces of the rolls 2 can be provided with layers of elastomeric material.

If the apparatus of FIGS. 1 and 2 operates with a supply of wetting agent (i.e., if the vessel 17 contains a supply of tenside or another suitable wetting agent), the pulley 9 and particularly the rolls 2 ensure that a required percentage of wetting agent is expelled from successive increments of the web 1 before such increments enter the liquid bath 3 above the nip N. If the vessel 17 does not contain a supply of wetting agent, the rolls 2 cooperate to expel air from the moving web 1 immediately beneath the liquid bath 3 between the peripheral surfaces 2*a* and the end walls 8. A suitably inclined trough 14 is provided between the walls W of the housing H to direct the expelled wetting agent from the nip N back into the vessel 17.

The advancing rolls 15 can be preceded by a washing station wherein the web 1 is contacted by water or by another cleaning liquid. Surplus cleaning liquid is expelled by the advancing rolls 15 before the thus treated increments of the web 1 enter the body of wetting agent in the vessel 17.

The peripheral surfaces 2*a* of the rolls 2 entrain a certain amount of liquid from the bath in the vessel above the nip N. Such liquid forms two films which adhere to the peripheral surfaces 2*a* and are intercepted and wiped off the surfaces 2*a* by two rollers 4 which are adjacent the topmost portions of the respective rolls 2, i.e., the rollers 4 are located outside of and at a level above the liquid bath 3.

The illustrated apparatus further comprises means for expelling some of the liquid which is entrained by the web 1 above and away from the liquid bath 3. The expelling means comprises two rolls 6 which are mounted between the walls W of the housing H at a level above the vessel including the end walls 8 and the squeezing rolls 2. The width 7 of the nip NN between the rolls 6 can be varied by at least one second shifting mechanism 12 which is or which can be identical with or similar to the shifting mechanism 13 and can move one or both rolls 6 in and counter to the directions indicated by arrows E. The arrows D indicate the direction of rotation of liquid removing or expelling rolls 6 when the web 1 is caused to move in the direction of arrow A. The liquid which is expelled by the rolls 6 flows back into the bath 3 above the nip N.

The feature that the rolls 2 prevent the liquid of the liquid bath 3 from flowing downwardly through the nip; that the liquid films which are entrained by the peripheral surfaces 2*a* of the rolls 2 are intercepted, wiped off the surfaces 2*a* and returned into the liquid bath; and that the rolls 6 return the surplus of entrained liquid into the bath 3 ensures that the apparatus can operate with a surprisingly small liquid bath.

The means 12 for shifting at least one of the rolls 6 toward or away from the other roll 6 can be adjusted by an operator who decides to select a particular width 7 of the nip NN or automatically in response to variations of pressure between the peripheral surfaces of the rolls 6 and successive increments of the upwardly moving web 1. FIG. 1 shows an intercepting and collecting device 11 which is installed between the walls W of the housing H and serves to collect the surplus liquid which is expelled by the rolls 6 and to return the thus collected liquid into the bath 3 above the nip N. The discharge end of the intercepting device 11 (which is or can be made of a metallic or plastic sheet material, depending upon the composition of the liquid bath 3) is located between the wiping rollers 4.

The pulley 10 at the top of the housing H deflects the impregnated web 1 in a downward direction for advancement toward and into a reaction chamber, e.g., a suitable drier or a steaming machine, not shown.

The apparatus further comprises means for replenishing the supply of liquid in the bath 3 above the nip N. The illustrated replenishing means comprises two nozzles 5 which are located above the rollers 4 and are outwardly adjacent the intercepting device 11. The nozzles 5 are preferably designed to continuously replenish the supply of liquid in the bath 3 at a rate which matches or at least closely approximates the rate of entrainment of liquid by the web 1 minus the rate of return flow of surplus liquid through the intercepting device 11. The rate of liquid flow into and from the nozzles 5 is preferably adjustable. The adjusting means can comprise a float 105 which serves to monitor the level of the top surface of the liquid bath 3 and controls one or more valves which, in turn, control the flow of fresh liquid from a suitable source into the nozzles 5.

The mode of operation of the improved apparatus is as follows:

If the vessel 17 is empty, successive increments of a dry web 1 can be moved directly from the nip of the advancing rolls 15 into the nip N wherein the web 1 moves upwardly, immediately thereafter through the bath 3 which is confined in the vessel including the rolls 2 and the end walls 8, and toward, into and upwardly beyond the nip NN of the liquid expelling rolls 6. If the web 1 is to be contacted by a wetting agent (e.g., a tenside) before it reaches the nip N of the rolls 2, the web is trained over the pulley 117 so that it passes through the liquid bath in the vessel 17 and is thereupon deflected and (if necessary) spread out by the pulley 9. The rolls 2 expel surplus air or surplus wetting agent from successive increments of the web 1 before such increments enter the bath 3 above the nip N. This ensures that the freshly squeezed increments of the web 1 act not unlike a sponge and are capable of accepting and entraining a requisite amount of liquid toward and into the nip NN of the surplus expelling or removing rolls 6. The web 1 which does not pass through the vessel 17 need not be dry, i.e., the advancing rolls 15 can be preceded by a washing or rinsing station and the surplus of washing or rinsing liquid is removed in part by the advancing rolls 15 and thereafter the squeezing rolls 2. The selected width 7 of the nip NN of the rolls 6 determines the percentage of expelled liquid which is returned into the bath above the nip N by the intercepting device 11. The arrangement may be such that at least one of the rolls 6 is adjusted at 12 in automatic response to a rise or drop of pressure in the nip NN to a predetermined maximum or minimum permissible value so that the rate of expulsion of surplus liquid is controlled by the pressure between the impregnated or permeated web 1 and the peripheral surfaces of the rolls 6. As a rule, only a relatively small percentage of entrained liquid will be expelled from the web 1 and returned into the bath 3 above the nip N.

The rolls 6 not only serve as a means for expelling surplus liquid but also as a means for ensuring more uniform penetration of liquid into and more uniform distribution of liquid in the web 1. Thus, successive increments of the web 1 can be rendered more receptive to penetration of liquid upstream of the nip N (namely by the wetting agent in the vessel 17 and/or by the squeezing rolls 2 which cause the freshly squeezed ascending increments of the web to act not unlike sponges) and downstream of the nip N (namely by the rolls 6 which force the liquid into the web 1 in the nip NN and remove only that surplus which cannot or should not be entrained by the web upwardly and beyond the rolls 6).

As mentioned above, an important advantage of the improved apparatus is that it can operate with a relatively small liquid bath 3 above the nip N. This brings about another advantage, namely that the liquid which forms the bath 3 is regenerated or renewed at frequent intervals. Therefore, the apparatus can operate satisfactorily without the need to control the bath 3 by titration and the concentration of the contents of liquid forming the bath 3 remains unchanged.

A further important advantage of the improved apparatus is its simplicity. The apparatus comprises a small number of relatively simple parts and need not be equipped with titrating means. Furthermore, the apparatus is versatile because it can process wide or narrow as well as thick or thin webs. The rolls 2 can expel surplus gases or surplus liquid and carry out such fluid-expelling function immediately beneath the liquid bath 3 so that the freshly squeezed increments of the ascending web are in optimum condition to absorb large quantities of liquid from the bath 3 above the nip N. It has been found that the rolls 2 increase the absorptivity of the web by several hundred percent because the squeezing action takes place before the web 1 can expand and draw air from the surrounding atmosphere on its way into the liquid bath 3 above the nip N. This is due to the fact that the rolls 2 form part of the vessel which further includes the end walls 8.

The mutual positions of the rolls 6 can be readily selected and maintained in such a way that the percentage of liquid per unit area of the web which advances above the nip NN is at least substantially constant. All this contributes to the quality of the ultimate product.

If the rolls 2 and/or 6 are driven in directions which are respectively indicated by arrows B and D, they form part of the means for moving the web 1 along its predetermined path.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of permeating a textile material with a liquid, comprising the steps of moving a web of textile material in a predetermined direction along a predetermined path inclining a first portion wherein the web moves from a lower level to a higher level and a second portion immediately preceding said first portion; squeezing the web in said second portion of said path; establishing and maintaining a liquid bath at said first portion of said path so that the web moves through and entrains liquid immediately following said squeezing step and while moving from said lower level to said higher level; expelling a portion of entrained liquid in a third portion of said path downstream of said first portion; and returning expelled liquid to said bath along a fourth portion of said path extending from the region of said bath towards said third portion of said path, the returning step including intercepting expelled liquid and guiding the intercepted liquid to said bath counter to said predetermined direction.

2. The method of claim 1, wherein at least one of said first and second portions of said path is at least substantially vertical.

3. The method of claim 1, wherein the web moves from a lower level to a higher level during movement along said second portion of said path.

4. The method of claim 1, further comprising the step of contacting the web with a wetting agent in an additional portion of said path upstream of said first portion.

5. The method of claim 4, wherein said additional portion is located upstream of the second portion of said path.

6. The method of claim 4, wherein the wetting agent is a tenside.

7. Apparatus for permeating a textile material with a liquid, comprising means for moving a web of textile material in a predetermined direction along a predetermined path inclining a first portion wherein the web is moved from a lower level to a higher level and a second portion immediately preceding said first portion; means for squeezing the web in the second portion of said path; a liquid bath-containing vessel surrounding said first portion of said path so that the web is contacted by liquid in said vessel while moving from said lower level to said higher level, immediately following squeezing in said second portion of said path and entrains some liquid from the bath; means for expelling a portion of entrained liqiud from the web in a third portion of said path downstream of said first portion; and means for returning expelled liquid to the bath, said returning means including a device between said expelling means and said bath for intercepting expelled liquid and guiding the intercepted liquid to the bath, and said device having a discharge end in the region of the bath and defining a fourth portion of said path in which expelled liquid travels counter to said predetermined direction.

8. The apparatus of claim 7, wherein at least one of said first and second portions of said path is at least substantially vertical.

9. The apparatus of claim 7, wherein said squeezing means includes a pair of rolls defining for the moving web a substantially horizontal nip in the second portion of said path, said moving means being operative to move successive increments of the web upwardly through said nip and into the liquid bath in said vessel.

10. The apparatus of claim 7, wherein said squeezing means forms part of said vessel.

11. The apparatus of claim 10, wherein said squeezing means comprises two rolls having first and second end faces and defining a nip which is located between said first and second end faces and wherein the web moves upwardly into the liquid bath in said vessel, said vessel further comprising first and second end walls sealingly engaging said first and second end faces, respectively.

12. The apparatus of claim 11, wherein said rolls have peripheral surfaces which entrain liquid from the bath;

and further comprising means for wiping the liquid off said peripheral surfaces outside of the liquid bath in said vessel.

13. The apparatus of claim 12, wherein said wiping means includes rollers contacting said peripheral surfaces at a level above the liquid bath in said vessel so as to return the wiped off liquid into the bath.

14. The apparatus of claim 7, further comprising means for replenishing the supply of liquid in said vessel so as to compensate for entrainment of some liquid by successive increments of the moving web.

15. The apparatus of claim 14, wherein said replenishing means is adjustable and further comprising means for adjusting said replenishing means so as to maintain the supply of liquid forming said bath at a substantially constant value, said adjusting means comprising means for monitoring the level of the top surface of liquid bath in said vessel.

16. The apparatus of claim 7, wherein said squeezing means comprises a first pair of rolls defining a first nip for the web and said expelling means comprises a second pair of rolls defining a second nip for the web; and further comprising means for shifting at least one roll of at least one of said pairs relative to the other roll of the respective pair to thereby vary the width of the respective nip.

17. The apparatus of claim 16, wherein said shifting means includes a fluid-operated motor.

18. The apparatus of claim 7, further comprising means for contacting the web with a wetting agent in an additional portion of said path upstream of said first portion.

19. The apparatus of claim 18, wherein said contacting means comprises a tenside.

20. The apparatus of claim 9, wherein the bath contains a chemical substance and at least one of said first and second portions is at least substantially vertical, said squeezing means forming part of said vessel and including a pair of first rolls having first and second end faces and peripheral surfaces which entrain liquid from the bath, and said vessel further comprising first and second end walls sealing engaging the respective first and second end faces, said first rolls defining for the moving web a substantially horizontal first nip in the second portion of said path between said end faces, and said moving means being operative to move successive increments of the web upwardly through said first nip and into the bath in said vessel, said expelling means including a pair of second rolls defining a second nip for the web; and further comprising means for rotating said first rolls in opposite directions so as to move the web upwardly into the bath, means for wiping the liquid off said peripheral surfaces outside of the bath in said vessel, adjustable means for replenishing the supply of liquid in said vessel so as to compensate for entrainment of some liquid by successive increments of the moving web, means for adjusting said replenishing means so as to maintain the supply of liquid forming said bath at a substantially constant value, and means for shifting at least one roll of at least one of said pairs relative to the other roll of the respective pair to thereby vary the width of the respective nip, said adjusting means including means for monitoring the level of the top surface of the bath in said vessel.

* * * * *